US005097173A

United States Patent [19]

Schmidt et al.

[11] Patent Number: 5,097,173

[45] Date of Patent: * Mar. 17, 1992

[54] CHANNEL ELECTRON MULTIPLIER PHOTOTUBE

[75] Inventors: Kenneth C. Schmidt, Wilbraham, Mass.; James L. Knak, Spofford, N.H.

[73] Assignee: K and M Electronics, Inc., West Springfield, Mass.

[ * ] Notice: The portion of the term of this patent subsequent to Oct. 30, 2007 has been disclaimed.

[21] Appl. No.: 558,761

[22] Filed: Jul. 27, 1990

Related U.S. Application Data

[63] Continuation-in-part of Ser. No. 318,652, Mar. 3, 1989, Pat. No. 4,967,115, which is a continuation-in-part of Ser. No. 217,689, Jul. 11, 1988, abandoned, which is a continuation of Ser. No. 932,267, Nov. 19, 1986, Pat. No. 4,757,229.

[51] Int. Cl.[5] ..... H01J 43/03; H01J 43/28

[52] U.S. Cl. ..... 313/103 CM; 313/105 CM

[58] Field of Search ..... 313/103 CM, 105 CM, 313/373, 376

[56] References Cited

U.S. PATENT DOCUMENTS

| | | | |
|---|---|---|---|
| 3,128,408 | 4/1964 | Goodrich et al. | 313/103 |
| 3,244,922 | 4/1966 | Wolfgang | 313/95 |
| 3,612,946 | 10/1971 | Toyoda | 313/105 |
| 3,790,840 | 2/1974 | Toyoda | 313/105 |
| 4,095,132 | 6/1978 | Fraioli | 313/103 CM |
| 4,967,115 | 10/1990 | Schmidt et al. | 313/103 CM |

FOREIGN PATENT DOCUMENTS 1121858 4/1982 Canada .

OTHER PUBLICATIONS

Vacumetrics, Inc. Catalog 1984/85, pp. 40–41.

*Primary Examiner*—Sandra L. O'Shea
*Attorney, Agent, or Firm*—Lahive & Cockfield

[57] ABSTRACT

A channel electron multiplier phototube having a channel electron multiplier, a transparent faceplate, and an anode assembly. The channel electron multiplier includes an insulating body having a curved passageway extending therethrough. A photoemissive element, and a secondary emissive dynode material is on the walls of the passageway. The passageway, together with a photoemission film of the photocathode assembly and the anode of the anode assembly define an evacuated closed region. Preferably, the electron multiplier is a monolithic ceramic body.

18 Claims, 4 Drawing Sheets

CHANNEL ELECTRON MULTIPLIER PHOTOTUBE

REFERENCE TO RELATED APPLICATIONS

This application is a continuation-in-part of U.S. Pat. Application Ser. No. 318,652, filed Mar. 3, 1989, now U.S. Pat. No. 4,467,115, which is a continuation-in-part of U.S. Pat. Application Ser. No. 217,689, filed July 11, 1988 which is a continuation of U.S. Pat. Application Ser. No. 932,267, filed Nov. 19, 1986, now U.S. Pat. No. 4,757,229.

BACKGROUND OF THE INVENTION

This invention relates to an improved channel electron multiplier made from a monolithic ceramic body and a method of making same. In particular it relates to a channel electron multiplier wherein said channel provides a preferably three dimensional, curved conduit for increased electron/wall collisions and for a device of smaller dimension, particularly when longer channel length is required. The invention further relates to phototubes employing those and similar electron multipliers, and to placement of the photoemission element relative to both the faceplate and passageway surface.

Electron multipliers are typically employed in multiplier phototubes where they serve as amplifiers of the current emitted from a photocathode when impinged upon by a light signal. In such prior art multiplier phototube devices, the photocathode, electron multiplier and other functional elements are enclosed as discrete elements in a surrounding vacuum envelope, for example an envelope made of glass. The vacuum environment inside the envelope is essentially stable and is controlled during the manufacture of the tube for optimum operational performance. The electron multiplier in this type of application generally employs a discrete metal alloy dynode such as formed from beryllium-copper or silver-magnesium alloys. Generally, the electron multiplier must be mounted as a discrete element within the envelope, and, as a result, the phototube device is susceptible to damage due to vibration and shock. Further, since the multiplier is wholly within the vacuum envelope, there is relatively poor thermal coupling between the hot dynode surfaces of the multiplier and the ambient external environment of the phototube.

There are other applications for electron multipliers that do not require a vacuum envelope. Such applications are, for example, in a mass spectrometer where ions are to be detected, and in an electron spectrometer where electrons are to be detected. In these applications the signal to be detected, i.e. ions or electrons, cannot penetrate the vacuum envelope but must instead impinge directly on the dynode surface of a "windowless" electron multiplier.

Electron multipliers with discrete metal alloy dynodes are not well suited for "windowless"applications in that secondary emission properties of their dynodes suffer adversely when exposed to the atmosphere. Furthermore, when the operating voltage is increased to compensate for the loss in secondary emission characteristics, the discrete dynode multiplier exhibits undesirable background signal (noise) due to field emission from the individual dynodes. For these reasons, a channel electron multiplier is often employed wherever "windowless"detection is required.

U.S. Pat. No. 3,128,408 to Goodrich et al discloses a channel multiplier device comprising a smooth glass tube having a straight axis with an internal semiconductor dynode surface layer which is most likely rich in silica and therefore a good secondary emitter. The "continuous" nature of said surface is less susceptible to extraneous field emissions, or noise, and can be exposed to the atmosphere without adversely effecting its secondary emitting properties.

Smooth glass tube channel electron multipliers have a relatively high negative temperature coefficient of resistivity (TCR) and a low thermal conductivity. Thus, they must have relatively high dynode resistance to avoid the creation of a condition known as "thermal runaway". This is a condition where, because of the low thermal conductivity of the glass channel electron multiplier, the ohmic heat of the dynode cannot be adequately conducted from the dynode, the dynode temperature continues to increase, causing further decrease in the dynode resistance until a catastrophic overheating occurs.

To avoid this problem, channel electron multipliers are manufactured with a relatively high dynode resistance. If the device is to be operable at elevated ambient temperature, the dynode resistance must be even higher. Consequently, the dynode bias current is limited to a low value (relative to discrete dynode multipliers) and its maximum signal is also limited proportionately. As a result, the channel multiplier frequently saturates at high signal levels and thus does not behave as a linear detector. It will be appreciated that ohmic heating of the dynode occurs as operating voltage is applied across the dynode. Because of the negative TCR, more electrical power is dissipated in the dynode, causing more ohmic heating and a further decrease in the dynode resistance.

In an effort to alleviate the deficiences of the typical glass tube channel multiplier, channel multipliers formed from ceramic supports have been developed. Such devices are exemplified in U.S. Pat. No. 3,244,922 to L G Wolfgang U.S. Pat. No. 4,095,132 to A. V. Fraioli and U.S. Pat. No. 3,612,946 to Toyoda.

As shown and described in U.S. Pat. Nos. 3,244,922 and 4,095,133, the electron multiplier is formed from two sections of ceramic material wherein a passageway or conduit is an elongated tube cut into at least one interior surface of the two ceramic sections. While such a channel can be curved as shown in the patent to Fraioli or undulating as shown in the patent to Wolfgang, each is limited to a two-dimensional configuration and thus may create only limited opportunities for electron/wall collisions.

In U.S. Pat. No. 3,612,946, a semi conducting ceramic material serves as the body and the dynode surface for the passage contained therein. For this device to function as an efficient channel electron multiplier, the direction of the longitudinal axis of its passage must essentially be parallel to the direction of current flow through the ceramic material, such a current flow resulting from the application of the electric potential required for operation.

The present invention is an improvement of the channel multiplier phototube devices of the prior art discussed above in that it combines the beneficial operation of the glass tube-type channel multiplier and the discrete dynode multiplier and adds a ruggedness and ease of manufacture heretofore unknown.

Accordingly, it is an object of the present invention to provide a channel electron multiplier phototube device which has a high gain with a minimum of background noise.

It is another object of the present invention to provide a phototube device including a channel multiplier having a dynode layer formed from a semiconducting material having good secondary emitting properties.

It is another object of the present invention to provide a phototube device including a channel multiplier having a 3-dimensional passageway therethrough so as to optimize electron/wall collisions and to provide for longer channels in a compact configuration.

It is another object of the present invention to provide a rugged, easily manufactured phototube device including a channel multiplier.

It is a further object of the present invention to provide a phototube device including a channel multiplier which can also serve as the insulating support for electrical leads, mounting brackets, aperture plates, photocathodes, signal anodes, and the like.

It is a further object of the present invention to provide a phototube device having an improved photocathode configuration.

The above and other objects and advantages of the invention will become more apparent in view of the following description in terms of the embodiments thereof which are shown in the accompanying drawings. It is to be understood, however, that the drawings are for illustration purposes only and not presented as a definition of the limits of the present invention.

SUMMARY OF THE INVENTION

An electron multiplier phototube includes an electron multiplier, a photocathode assembly, transparent faceplate, and an anode assembly. The electron multiplier includes an electrical insulating body having at least one entrance port and at least one exit port and at least one hollow passageway through the body between each pair of entrance and exit ports. The interior walls of the hollow passageways include secondary-emissive dynode materials. In one form, a photoemission element is positioned on portions of the interior walls underlying the faceplate. In another form, the element is on a support extending from the interior of the entryway and underlying the transparent faceplate.

The anode assembly includes an anode and an output signal coupler, and a support for the anode. The anode assembly is sealed to the insulating body so that the anode is contiguous with the region interior to the passageway at the exit port.

With this configuration, the passageways, the transparent faceplate, and the anode assembly define closed regions including the photoemission element, the walls of the passageways, and anode. This closed region is substantially evacuated.

DESCRIPTION OF THE DRAWINGS

Referring now to the drawings, wherein like elements are numbered alike in the several FIGURES.

DESCRIPTION OF THE PREFERRED EMBODIMENT

Figure 1:
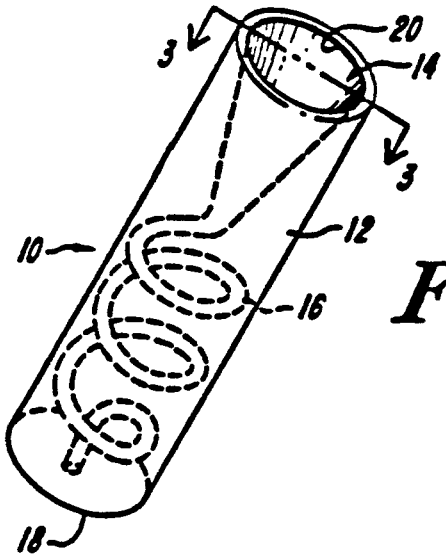
FIG. 1 is a perspective view of a channel electron multiplier of the present invention.
Figure 3:
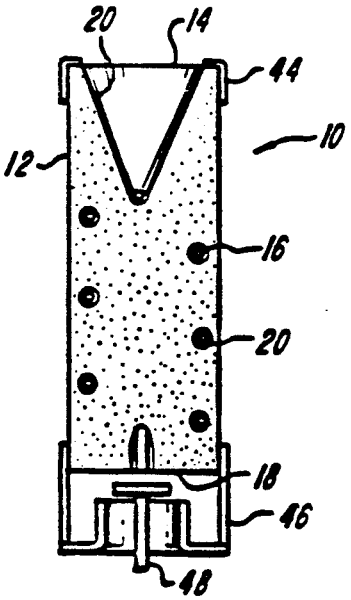
FIG. 3 is a sectional view taken along lines 3—3 of FIG. 1 with additional support and electrical elements thereon.

Referring to FIG. 1 and 3, a channel multiplier constructed in a form useful with the present invention is shown at 10. It is comprised of a monolithic electrically insulating, ceramic material. It will be appreciated that the problems of registration and seams in the channel passage, as disclosed, for example in the above-discussed U.S. Pat. Nos. 3,244,922 and 4,095,133, are obviated by the monolithic body.

In the embodiment shown in FIGS. 1 and 3, the monolithic body 12 of the multiplier is cylindrical in shape. As will be further noted, one end of said body may be provided with a cone or funnel shaped entryway or entry port 14 which evolves to a hollow passageway or channel 16. The channel 16 preferably is three dimensional and may have one or more turns therein which are continuous throughout the body 12 of the multiplier 10 and exits the multiplier 10 at an exit port at the opposite end 18 of the cylinder shaped body from the entryport 14. It will also be appreciated that the passage of the channel must be curved in applications where the multiplier gain is greater than about $1 \times 10^6$ to avoid instability caused by "ion feedback".

The surface 20 of the funnel shaped entryway 14 and the hollow passageway 16 is coated with a semiconducting material having good secondary emitting properties. Said coating is hereinafter described as a dynode layer. As discussed further below, in relation to FIG. 7, the surface 20 may be coated with a photoemission film 36*a* which acts as the photoemission element of the invention.

FIG. 3 is a modified version of FIG. 1, wherein an input collar 44 is press fit onto the ceramic body 12 and is used to make electrical contact with entry port 14. An output flange 46 is also pressed onto the ceramic body 12 and is used to position and hold a signal anode 48 and also to make electrical contact with exit port 18.

Figure 2:
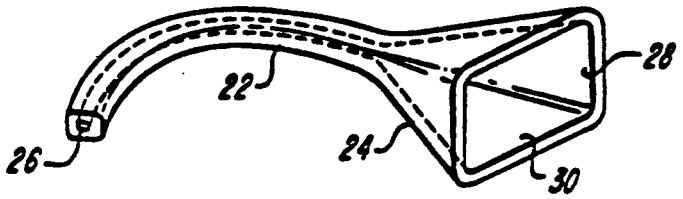
FIG. 2 is a perspective view of an embodiment of the present invention.

With reference to FIG. 2 the embodiment shown may be described as a free form channel multiplier. In said embodiment, the multiplier 10, comprises a tube-like curved body 22 having an enlarged funnel-shaped head 24. A passageway 26 is provided through the curved body 22 and communicates with the funnel-shaped entrance way 28. It will be appreciated that passageway 26 of FIG. 2 differs from passageway 16 of FIG. 1 in that passageway 26 comprises a two-dimensional passage of less than one turn. It is believed that the FIG. 1 embodiment may be preferable over the FIG. 2 embodiment depending on volume or packaging considerations. As in the embodiment of FIGS. 1 and 3, the surface 30 of the passageway 26 and entrance way 28 are coated with a dynode layer.

Figure 4:
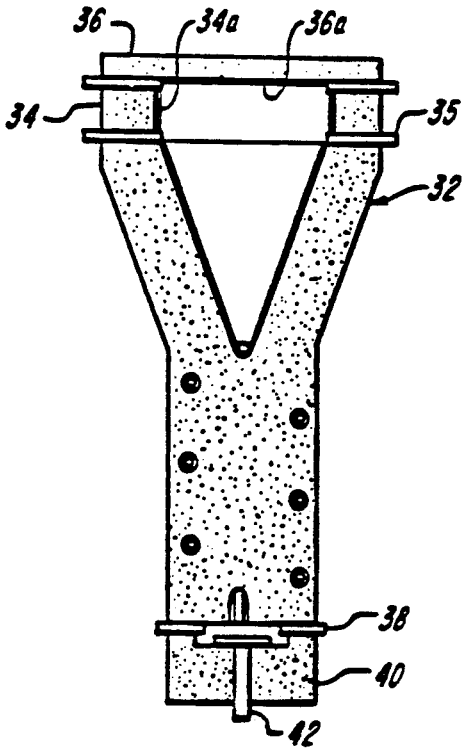
FIG. 4 is a sectional view, similar to that shown in FIG. 3, of a modified version of the channel electron multiplier of the present invention.

FIG. 4 discloses a further embodiment of the present invention wherein the channel multiplier 10 has the same internal configuration as that shown in FIGS. 1 and 3, but has different external configuration in that the body 32 is not in the form of a cylinder. For reasons to be explained below relating to the method of manufacturing the channel multiplier of the present invention, almost any desired shape may be employed for said multiplier.

Figure 5:
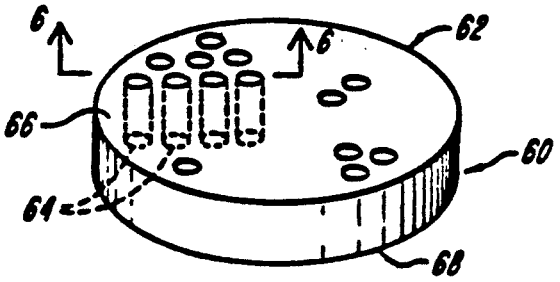
FIG. 5 is a perspective view of yet another channel electron multiplier of the present invention.
Figure 6:
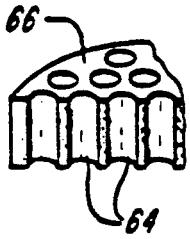
FIG. 6 is a cross-sectional elevation view along the line 6—6 of FIG. 5.

Turning now to FIGS. 5 and 6, an alternative embodiment of the present invention employing a plurality of hollow passageways or channels therein is shown generally at 60. Channel electron multiplier 60 is comprised of a unitary or monolithic body 62 of ceramic material with a multiplicity of hollow passages 64 interconnecting front and back surfaces 66, 68 of body 62. It will be appreciated that passages 64 may be straight, curved in two dimensions, or curved in three dimensions. Preferably, front and back surfaces 66, 68 are made conductive by metallizing them, while a dynode layer is coated on the passageways.

Figure 7:
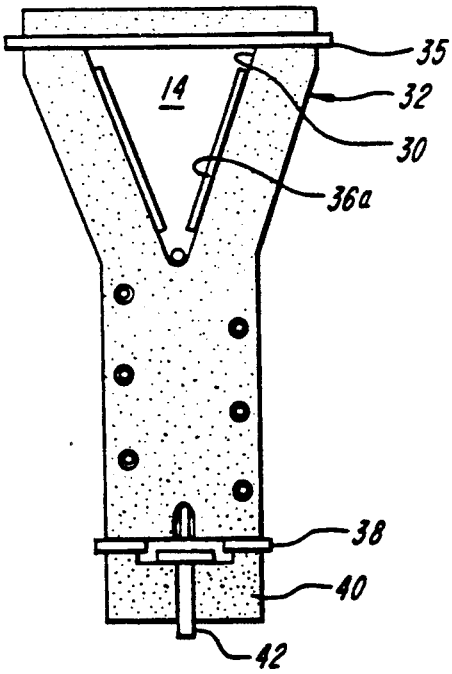
FIG. 7 is a sectional view, similar to that shown in FIG. 4, of an alternative embodiment of the phototube of the present invention.

FIG. 7 is a sectional view, similar to that shown in FIG. 4, of an alternative embodiment of the phototube of the present invention. In this illustrated embodiment, a lead glass resistive dynode material is disposed on the surface 20 of the funnel shaped entryway 14 and into passageway 26. A photoemission element 36*a*, in the form of photoemission film, is then applied to surface 20 of the funnel shaped entryway 14 overlying the dynode material. In other embodiments, the photoemission film is directly on surface 20, but not overlying the dynode which extends on the walls of the passageway exterior to the funnel-shaped region. Other locations for placement of the photoemission film may be appropriate, depending upon the specific configuration of the channel multiplier, and consistent with the description herein. Elements which correspond to elements in FIGS. 1–6 are denoted with identical reference numerals.

Figure 8:
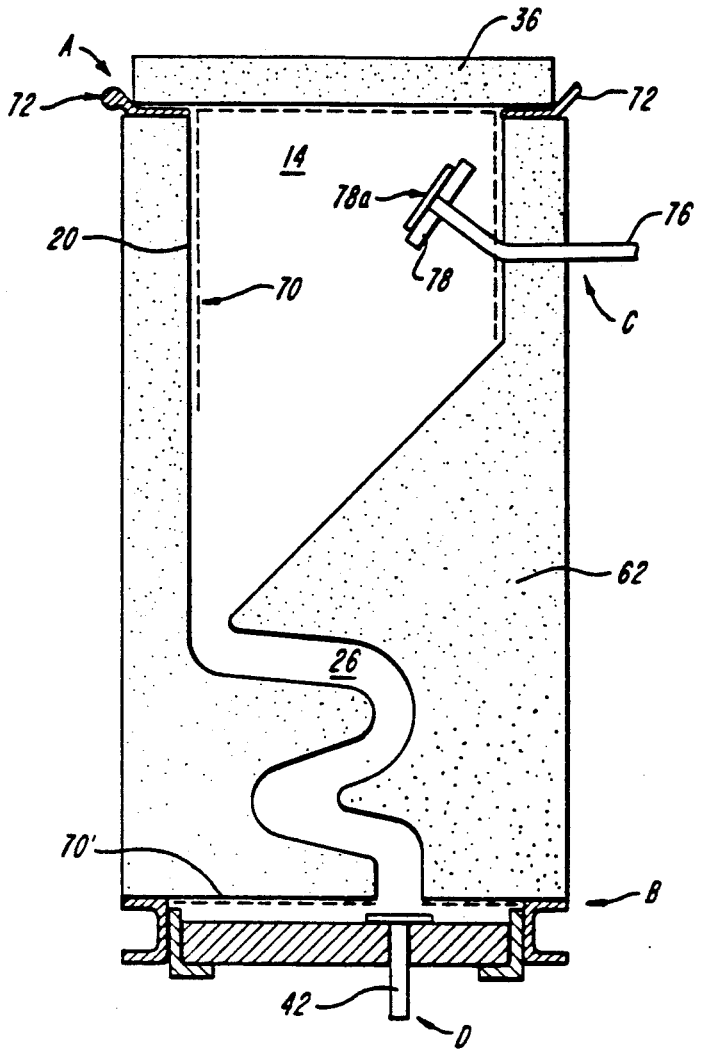
FIG. 8 is a sectional view, similar to that shown in FIG. 7, of an alternate embodiment of the phototube of the present invention.
Figure 9:
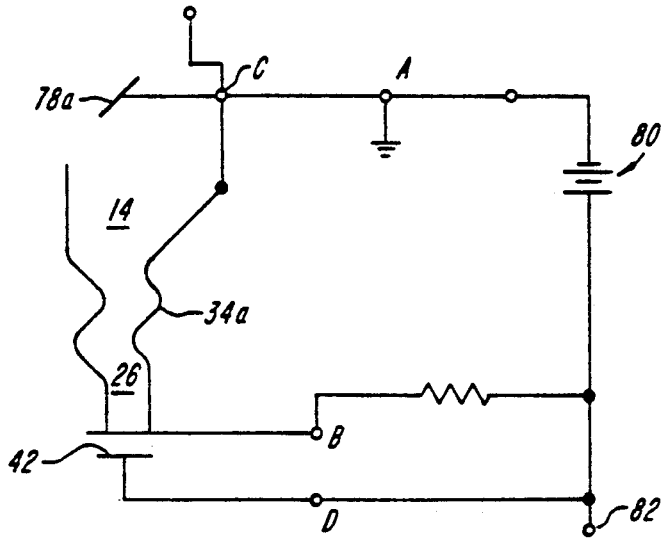
FIG. 9 is a schematic representation of an exemplary circuit configuration for use with the embodiment of FIG. 8.

FIG. 8 is a sectional view, similar to that shown in FIG. 7, of an alternative embodiment of the invention. In this illustrated embodiment, the upper portion of the surface 20 of the entryway 14 is coated with a metallized conductive coating 70, such as nichrome. The coating 70 extends under the faceplate, but is a transparent film in that region. A film 70′ may also coat the bottom of the multiplier at B. The coating 70 may be used to inhibit charge build-up on the surface 20, which distorts electron flow. The conductive coating may also be used for electrostatic field control. As shown in FIG. 9, the end of the multiplier denoted A may be grounded.

In the illustrated embodiment of FIG. 8, the transparent face plate 36 is coupled with the body 62 by means of a conductive seal 72, such as an indium alloy, or other maleable metal known generally in the field. The seal element 72 is in physical and electrical contact with the portions of conductive coating 70 on entryway 14 and on faceplate 36. Also shown in FIG. 8 is an optional external pin 76, which, as further shown in FIG. 9, is more negative than the end of the multiplier. In the illustrated embodiment, a pin 76 extends into the passageway 14, and includes a support 78 bearing a discrete photocathode 78*a* which acts in a manner similar to that of the photoemission film 36*a* described in relation to FIG. 7 above. It may also be used in conjunction with such a photoemission film.

In practice, and as shown in the schematic diagram of FIG. 9, the device may include a power supply 80 coupled between the cathode 78*a* at point C and the anode at point D, with a resistive lead from the positive end of the power supply 80 to the bottom film 70′at point B An output terminal 82 provides an output signal.

The monolithic ceramic body of the multiplier of the present invention may be fabricated from a variety of different materials such as alumina, beryllia, mullite, steatite and the like. The chosen material should be compatible with the dynode layer material both chemically, mechanically and thermally. It should have a high dielectric strength and behave as an electrical insulator.

The dynode layer to be used in the present invention may be one of several types. For example, a first type of dynode layer consists of a glass of the same generic type as used in the manufacture of conventional channel multipliers. When properly deposited on the inner passage walls, rendered conductive and adequately terminated with conductive material, it should function as a conventional channel multiplier. Other materials which give secondary electron emissive properties may also be employed.

The ceramic bodies for the multiplier of the present invention are fabricated using "ceramic"techniques.

In general, a preform in the configuration of the desired passageway to be provided therein is surrounded with a ceramic material such alumina and pressed at high pressure.

After the body containing the preform has been pressed, it is processed using standard ceramic techniques, such as bisquing and sintering. The preform will melt or burn-off during the high temperature processing thereby leaving a passageway of the same configuration as the preform.

Following shaping, the body is sintered to form a hard, dense body which contains a hollow passage therein in the shape of the previously burnt out preform. After cooling, the surface of the hollow passage may be coated by known techniques with a dynode material such as described earlier in this application. In addition, the surface may be coated by known techniques with a photoemission film, such as also described earlier in this application.

Figure 4A:
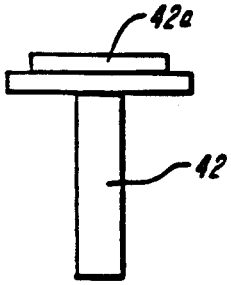
FIG. 4*a* is a schematic representation of an anode suitable for use in conjunction with the channel electron multiplier of the present invention.

Once the passageway has been coated with a dynode material and, in one embodiment, the entryway has been coated with a photoemission film, the aperture end and the output end have been metallized, the body may be fitted with various electrical and support connections as shown in FIGS. 4 and 7, such as an input collar or flange 35, a ceramic spacer ring 34, transparent faceplate 36 having, in one embodiment, a photoemission film 36*a* on its inner surface (as shown in FIG. 4), an output flange 38, and ceramic seal 40 with a signal anode 42 attached thereto. Alternatively, a discrete photoemission element may be supported near the inner surface of the faceplate. The faceplate 36 may be solid glass or may be an array of optical fibers. The anode 42 may, for example, include a phosphor on a support member, an array of charge-coupled diodes, or an array of discrete charge collecting anodes, having a metallic lead feeding through its support/seal 40. These features are schematically represented by member 42*a* in FIG. 4*a*. In such configuration as shown in FIG. 4, the device functions as a phototube vacuum envelope electron multiplier. While in the embodiment of FIG. 4, the faceplate 36 is coupled to the body 32 by discrete spacer ring 34 and flange 35, the invention may also be configured with the faceplate 36 coupled directly to the body 32. In yet other forms of the invention, a high gain dynode 34*a* may be operatively positioned between the photoemission element of the photocathode and the entrance port of the electron multiplier. In such configurations, it is still considered that the photoemission element is contiguous with the entrance port of the electron multiplier.

With the configuration of FIG. 4, with either a monolithic body or multiple element body, a separate glass or ceramic tube body, or other form of vacuum envelope is not required, thus simplifying fabrication of the phototube. Moreover, the phototube of the invention is much more rugged than prior art devices with separate bodies. In such prior art devices, the multipliers are mounted as separate elements and are thus susceptible to damage from vibration and shock.

With the phototube of the present invention where the exterior surface of the monolithic ceramic channel electron multiplier is at atmospheric pressure and ambient temperature, heat generated on the inner dynode surface is efficiently transferred to this exterior surface where it can be efficiently dissipated by convection cooling as well as radiation and conduction cooling. This latter factor Provides a substantial operating advantage over the prior art phototubes. The channel electron multiplier phototube of the present invention provides signal current levels greater than attained heretofore by other types of channel electron multiplier (CEM) phototubes. In fact, the present invention provides signal current levels approaching those of discrete dynode phototubes, and, as a result, does not require a separate resistor chain and multiple electrical vacuum feedthru connections as do discrete dynode multiplier phototubes.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An electron multiplier phototube comprising:

A. an electron multiplier including an electrical insulating body, at least one entrance port in said body and at least one exit port in said body, at least one hollow passageway extending through said body between each pair of entrance and exit ports, and the interior walls of said hollow passageways including secondary-emissive dynode material and a photoemission element, wherein said photoemission element underlies said entrance port, B. a transparent faceplate, and a support therefore, C. means for sealing said transparent faceplate to said insulating body, D. an anode assembly including an anode and an output signal coupler, and including a support for said anode, E. means for sealing said anode assembly to said insulating body whereby said anode is contiguous with the region interior to said passageway at said exit port, wherein said passageway, said transparent faceplate, and said anode assembly define a closed region including said photoemission element, said walls of said passageway, and said anode, said closed region being substantially evacuated.

2. The electron multiplier phototube of claim 1 wherein:

said body is formed from a ceramic material.

3. The electron multiplier phototube of claim 2 wherein:

said hollow passageway has at least one turn therein.

4. The electron multiplier phototube of claim 2 wherein:

said passageway forms a two dimensional curve in said body.

5. The electron multiplier phototube of claim 3 wherein:

said passageway forms a three dimensional curve in said body.

6. The electron multiplier phototube of claim 5 wherein:

said three dimensional curve is a helix or spiral.

7. The electron multiplier phototube of claim 2 wherein:

the entrance port includes a funnel shaped portion.

8. The electron multiplier phototube of claim 2 wherein:

said dynode material is a glass having an electrically conductive surface.

9. The electron multiplier phototube of claim 1 wherein:

said passageway is seamless.

10. The electron multiplier phototube according to claim 1 wherein said insulating body is monolithic.

11. The electron multiplier phototube according to claim 1 wherein said anode includes a phosphor and associated support therefore

12. The electron multiplier phototube according to claim 1 wherein said anode includes an array of charge-coupled diodes.

13. The electron multiplier phototube according to claim 1 wherein said anode includes an array of discrete charge collecting anodes.

14. The electron multiplier phototube according to claim 1 wherein said faceplate comprises a plurality of optical fibers.

15. The electron multiplier phototube according to claim 1 wherein said photoemission element is a photoemission film on one surface of said walls of said hollow passageway.

16. The electron multiplier phototube according to claim 1 further including a dynode between said photoemission element and said entrance port.

17. The electron multiplier phototube according to claim 16 wherein said photoemission element is contiguous with said dynode.

18. The electron multiplier phototube of claim 1 further including:

a support member extending from the walls of said body defining said passageway into said passageway, and including means for supporting said photoemission element in said passageway, wherein said photoemission element is positioned on said support member.

* * * * *